US008939210B2

(12) United States Patent
Bell et al.

(10) Patent No.: US 8,939,210 B2
(45) Date of Patent: Jan. 27, 2015

(54) DRILL COLLAR SEVERING TOOL

(71) Applicants: William T. Bell, Huntsville, TX (US); James G. Rairigh, Houston, TX (US)

(72) Inventors: William T. Bell, Huntsville, TX (US); James G. Rairigh, Houston, TX (US)

( * ) Notice: Subject to any disclaimer, the term of this patent is extended or adjusted under 35 U.S.C. 154(b) by 0 days.

(21) Appl. No.: 14/120,409

(22) Filed: May 19, 2014

(65) Prior Publication Data

US 2014/0338910 A1 Nov. 20, 2014

Related U.S. Application Data

(60) Provisional application No. 61/855,660, filed on May 20, 2013.

(51) Int. Cl.
*E21B 29/02* (2006.01)
*F42B 3/02* (2006.01)

(52) U.S. Cl.
CPC ..... *E21B 29/02* (2013.01)
USPC ..... 166/297; 166/299; 166/55; 166/63; 102/315; 102/318

(58) Field of Classification Search
CPC ..... E21B 29/02; E21B 31/002
USPC ..... 166/297, 299, 377, 55, 63, 376; 89/1.15, 1.151; 102/304, 313, 315, 102/318, 322, 331, 332, 333, 701
See application file for complete search history.

(56) References Cited

U.S. PATENT DOCUMENTS

| | | | | | |
|---|---|---|---|---|---|
| 2,775,940 | A * | 1/1957 | Klotz, Jr. | ..... | 102/313 |
| 2,935,020 | A * | 5/1960 | Howard et al. | ..... | 102/307 |
| 4,184,430 | A | 1/1980 | Mock | | |
| 4,286,520 | A * | 9/1981 | Davis | ..... | 102/317 |
| 4,290,486 | A | 9/1981 | Regalbuto | | |
| 4,352,397 | A | 10/1982 | Christopher | | |
| 4,378,844 | A * | 4/1983 | Parrish et al. | ..... | 166/297 |
| 4,537,255 | A | 8/1985 | Regalbuto et al. | | |
| 4,998,477 | A | 3/1991 | Barker | | |
| 5,159,145 | A | 10/1992 | Carisella et al. | | |
| 5,780,764 | A | 7/1998 | Welch et al. | | |
| 6,959,765 | B2 | 11/2005 | Bell | | |
| 6,962,203 | B2 | 11/2005 | Funchess | | |
| 7,073,589 | B2 * | 7/2006 | Tiernan et al. | ..... | 166/308.2 |
| 7,104,326 | B2 * | 9/2006 | Grattan et al. | ..... | 166/297 |
| 7,530,397 | B2 | 5/2009 | Bell | | |
| 7,698,982 | B2 | 4/2010 | Bell | | |
| 8,342,095 | B2 * | 1/2013 | Bassett | ..... | 102/333 |
| 2007/0074624 | A1 * | 4/2007 | Bell | ..... | 89/1.15 |

* cited by examiner

*Primary Examiner* — Kenneth L Thompson

(57) ABSTRACT

A pipe severing tool is arranged to align a plurality of high explosive pellets along a unitizing central tube that is selectively separable from a tubular external housing. The pellets are loaded serially in a column in full view along the entire column as a final charging task. Detonation boosters are prepositioned and connected to detonation cord for simultaneous detonation at opposite ends of the explosive column. Devoid of high explosive pellets during transport, the assembly may be transported with all boosters and detonation cord connected.

13 Claims, 1 Drawing Sheet

DETAIL A

DETAIL B

DRILL COLLAR SEVERING TOOL

CROSS REFERENCE TO RELATED APPLICATIONS

This application claims the May 20, 2013 Priority Date benefit of Provisional Application No. 61/855,660.

STATEMENT REGARDING FEDERALLY SPONSORED RESEARCH OR DEVELOPMENT

Not applicable

BACKGROUND OF THE INVENTION

1. Field of the Invention

The present invention relates to the earthboring arts. More particularly, the invention relates to methods and devices for severing drill pipe, casing and other massive tubular structures by the remote detonation of an explosive cutting charge.

2. Description of Related Art

Deep well earthboring for gas, crude petroleum, minerals and even water or steam requires tubes of massive size and wall thickness. Tubular drill strings may be suspended into a borehole that penetrates the earth's crust several miles beneath the drilling platform at the earth's surface. To further complicate matters, the borehole may be turned to a more horizontal course to follow a stratification plane.

The operational circumstances of such industrial enterprise occasionally presents a driller with a catastrophe that requires him to sever his pipe string at a point deep within the wellbore. For example, a great length of wellbore sidewall may collapse against the drill string causing it to wedge tightly in the well bore. The drill string cannot be pulled from the well bore and in many cases, cannot even be rotated. A typical response for salvaging the borehole investment is to sever the drill string above the obstruction, withdraw the freed drill string above the obstruction and return with a "fishing" tool to free and remove the wedged portion of drill string.

Drill string weight bearing on the drill bit necessary for advancement into the earth strata is provided by a plurality of specialty pipe joints having atypically thick annular walls. In the industry vernacular, these specialty pipe joints are characterized as "drill collars". A drill control objective is to support the drill string above the drill collars in tension. Theoretically, only the weight of the drill collars bears compressively on the drill bit. With a downhole drilling motor configured for deviated bore hole drilling, the drill motor, bent sub and drill bit are positioned below the drill collars. This drill string configuration does not rotate in the borehole above the drill bit. Consequently, the drill collar section of the drill string is particularly susceptible to borehole seizures and because of the drill collar wall thickness, is also difficult to cut, When an operational event such as a "stuck" drill string occurs, the driller may use wireline suspended instrumentation that is lowered within the central, drill pipe flow bore to locate and measure the depth position of the obstruction. This information may be used to thereafter position an explosive severing tool within the drill pipe flow bore.

Typically, an explosive drill pipe severing tool comprises a significant quantity, 800 to 1,500 grams for example, of high order explosive such as RDX, HMX or HNS. The explosive powder is compacted into high density "pellets" of about 22.7 to about 38 grams each. The pellet density is compacted to about 1.6 to about 1.65 gms/cm$^3$ to achieve a shock wave velocity greater than about 30,000 ft/sec, for example. A shock wave of such magnitude provides a pulse of pressure in the order of $4\times10^6$ psi. It is the pressure pulse that severs the pipe.

In one form, the pellets are compacted at a production facility into a cylindrical shape for serial, juxtaposed loading at the jobsite as a column in a cylindrical barrel of a tool cartridge. Due to weight variations within an acceptable range of tolerance between individual pellets, the axial length of explosive pellets fluctuates within a known tolerance range. Furthermore, the diameter-to-axial length ratio of the pellets is such that allows some pellets to wedge in the tool cartridge barrel when loaded. For this reason, a go-no-go type of plug gauge is used by the prior art at the end of a barrel to verify the number of pellets in the tool barrel. In the frequent event that the tool must be disarmed, the pellets may also wedge in the barrel upon removal. A non-sparking depth-rod is inserted down the tool barrel to verify removal of all pellets.

Extreme well depth is often accompanied by extreme hydrostatic pressure. Hence, the drill string severing operation may need to be executed at 10,000 to 20,000 psi. Such high hydrostatic pressures tend to attenuate and suppress the pressure of an explosive pulse to such degree as to prevent separation.

One prior effort by the industry to enhance the pipe severing pressure pulse and overcome high hydrostatic pressure suppression has been to detonate the explosive pellet column at both ends simultaneously. Theoretically, simultaneous detonations at opposite ends of the pellet column will provide a shock front from one end colliding with the shock front from the opposite end within the pellet column at the center of the column length. On collision, the pressure is multiplied, at the point of collision, by about 4 to 5 times the normal pressure cited above. To achieve this result, however, the detonation process, particularly the simultaneous firing of the detonators, must be timed precisely in order to assure collision within the explosive column at the center.

Such precise timing is typically provided by means of mild detonating fuse and special boosters. However, if fuse length is not accurate or problems exist in the booster/detonator connections, the collision may not be realized at all and the device will operate as a "non-colliding" tool with substantially reduced severing pressures.

The reliability of state-of-the-art severing tools is further compromised by complex assembly and arming procedures required at the well site. With those designs, regulations require that explosive components (detonator, pellets, etc.) must be shipped separately from the tool body. Complete assembly must then take place at the well site under often unfavorable working conditions.

Finally, the electric detonators utilized by many state-of-the-art severing tools are vulnerable to electric stray currents and uncontrolled RF energy sources thereby further complicating the safety procedures that must be observed at the well site.

SUMMARY OF THE INVENTION

The pipe severing tool of the present invention comprises an outer housing that is a metallic tube of such outside diameter that is compatible with the drill pipe flow bore diameter intended for use. The lower end of the housing tube is sealed with a nose plug. The inside transverse surface of the nose plug is preferably faced with shock absorbers in the form of silicon washers. The housing upper end is plugged with a detonation booster carrier. The inside face of the booster carrier supports a pellet guide tube that extends along the housing tube axis for substantially the full length of the housing. At the distal end of the guide tube opposite from the booster carrier, a non-ferrous terminal is threaded into the internal bore of the guide tube.

A first bi-directional booster is secured within the guide tube bore at the booster carrier end. The first bi-directional booster secures the ends of two mild detonation cords within the bi-directional booster case proximate of a small quantity of explosive material. Both cords are of the same length. One cord continues along the axial bore of the guide tube to the terminal end of the guide tube. At the terminal end, the cord end is secured within the case of a second bi-directional booster. A first window aperture is provided in the guide tube wall adjacent to the second bi-directional booster.

The second mild detonation cord exits the guide tube bore through a second tube wall window proximate of the detonator carrier and is wound about a timing spool. A partition disc secured to the guide tube proximate of the lower end of the timing spool supports a third bi-directional booster. The lower end of the second detonation cord is secured within the case of the third booster.

With the housing tube separated from the detonator carrier and guide tube assembly and the guide tube terminal removed from the guide tube lower end, multiple pellets of explosive material are stacked along the length of the guide tube with the first pellet engaging the guide tube partition disc and third bi-directional booster. These pellets, each comprising a regulated weight quantity of explosive material powder, are pressed into an annular disc shape about an axially central aperture. The guide tube penetrates the axially central aperture. The outside diameter of the pellets corresponds to the inside diameter of the housing tube. The number of such pellets is determined by the severing objective.

For a given explosive pellet weight, dimensional parameters and pressed density, there will be thickness variations in individual pellets within tolerance limits. The first window aperture in the guide tube is positioned to be aligned between the second bi-directional booster and that explosive pellet at the lower distal end of the pellet column. The axial length of the window, however, should accommodate the cumulative length of the stacked explosive-column considering the tolerance limits.

With the predetermined number of explosive pellets in place along the guide tube length and the last or end-most pellet surrounding the first guide tube window, any exposed length between the last pellet and the distal end of the guide tube is filled with one or more resilient spacers. The guide tube end terminal is attached and the explosive assembly inserted into the hollow bore of the housing tube A bi-directional booster is positioned in the detonator carrier and armed for activation. The carrier and armed severing tool is attached to the well delivery string, such as tubing, and appropriately positioned within the well for discharge.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 2:
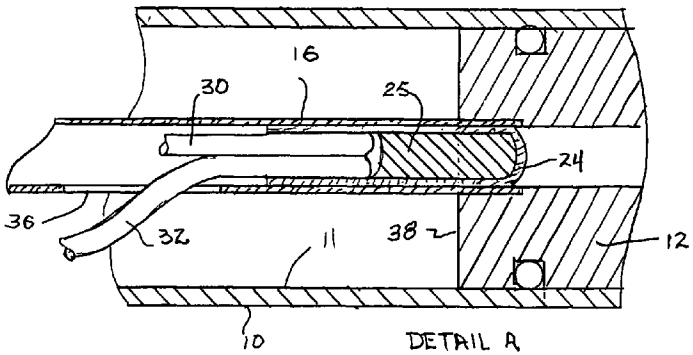
FIG. 2 is an enlargement of the FIG. 1 Detail A.
Figure 3:
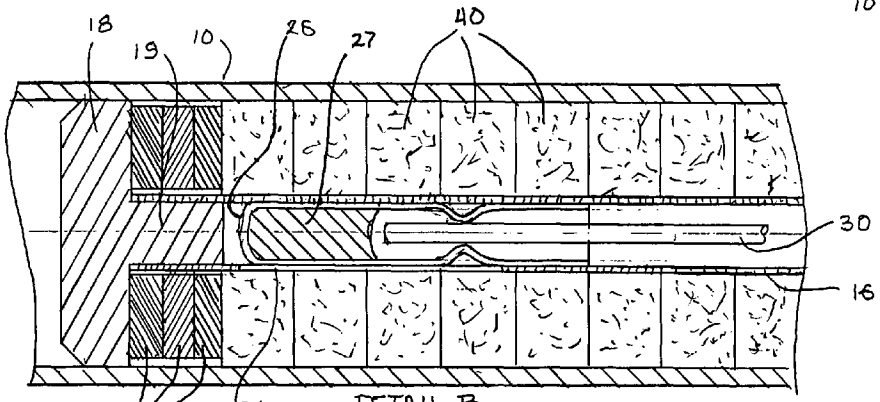
FIG. 3 is an enlargement of the FIG. 1 Detail B.
Figure 1:
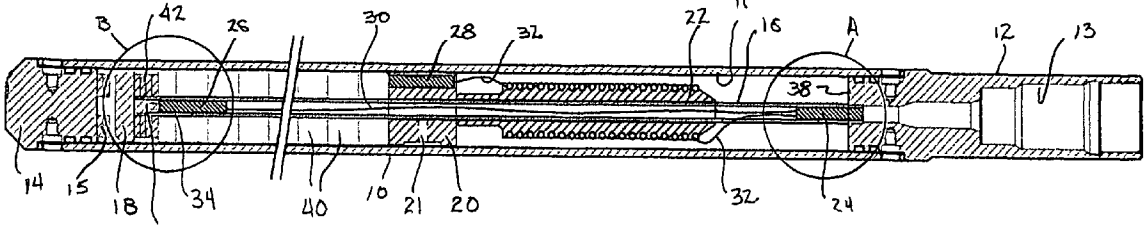
FIG. 1 is a sectional view of the invention as assembled for operation.

Referring to the FIG. 1 cross-sectional view of the invention, a tubular outer housing 10 includes an internal bore 11. The internal bore 11 is sealed at its lower end by a nose plug 14. The interior face of the nose plug is cushioned with a resilient padding 15 such as silicon gel.

The upper end of the internal bore 11 is sealed by a top carrier plug 12. An internal cavity 13 in the top carrier plug 12 is formed to receive a firing head not shown. Guide tube 16 is secured to the top plug 12 to project from the inside face 38 of the plug 12 along the housing 10 axis. The opposite distal end of guide tube 16 supports a guide tube terminal 18 which may be a disc having a diameter slightly less than the inside diameter of the housing internal bore 11. A threaded boss 19 secures the terminal 18 to the guide tube 16. One or more resilient spacers 42, such as silicon gel washers, are positioned to encompass the guide tube 16 and bear against the upper face of the terminal 18.

Near the upper end of the guide tube 16 is an adjustably positioned partition disc 20 secured by a set screw 21. Between the partition disc 20 and the inside face 38 of the top plug 12 is a timing spool 22. Preferably, the partition disc 20 and timing spool are axially juxtaposed.

Internally of the guide bore 16, at the upper end thereof, is first bi-directional booster 24 having a pair of mild detonating cords 30 and 32 secured within detonation proximity to a small quantity of explosive material 25. It is important that both detonation cords 30 and 32 are of the same length so as to detonate opposite ends of the explosive 40 column at the same moment. The first detonating cord 30 continues along the guide tube 16 bore to be secured within the second bi-directional booster 26 proximate of explosive material 27. A first window aperture 34 in the wall of guide tube 16 is cut opposite of the booster 26.

From the first bi-directional booster 24, the second detonating cord 32 is threaded through a second window aperture 36 in the upper wall of guide tube 16 and around the helical surface channels off the timing spool 22. Characteristically, the timing spool outside cylindrical surface is helically channeled to receive a winding lay of detonation cord with insulating material separations between adjacent wraps of the cord. The distal end of second detonating cord 32 terminates in a third bi-directional booster 28 that is set within a receptacle in the partition disc 20.

Preferably, the position of the partition disc 20 is adjustable along the length of the guide tube 16 to accommodate the anticipated number of explosive pellets 40 to be loaded.

For loading, the top plug 12, guide tube 16 and guide tube terminal 18 are withdrawn from the housing bore 11 as an assembled unit. While out of the housing bore 11, the guide tube terminal 18 is removed along with the resilient spacers 42.

Pellets 40 of powdered, high explosive material such as RDX, HMX or HNS are pressed into narrow wheel shapes often characterized by the industry vernacular as "pellets". A central aperture is provided in each pellet to receive the guide tube 16 therethrough. The pellets are loaded serially in a column along the guide tube 16 length with the first pellet in juxtaposition against the lower face of partition disc 20 and in detonation proximity with the third bi-directional booster 28. The last pellet most proximate of the terminus 18 is positioned adjacent to the first window aperture 34 in the tube guide tube wall Transportation safety limits the total weight of explosive in each pellet, generally, to less than 38 grams, for example. When pressed to a density of about 1.6 to about 1.65 gms/$cm^3$, pellet diameter, determines the pellet thickness within a determinable limit range. Accordingly, a predetermined total weight of explosive will determine the total number of pellets 40 to be aligned along the guide tube 16. From this data, the necessary length of the guide tube 16 to accommodate the requisite number of pellets is determinable to position the last pellet on the column adjacent the detonation window 34. Any space remaining between the face of the bottom-most pellet and the guide tube terminal 18 due to fabrication tolerance variations may be filled with resilient spacers 42.

Numerous modifications and variations may be made of the structures and methods described and illustrated herein without departing from the scope and spirit of the invention disclosed. Accordingly, it should be understood that the embodiments described and illustrated herein are only representative of the invention and are not to be considered as limitations upon the invention as hereafter claimed.

The invention claimed is:

1. An apparatus for explosively severing a length of pipe having an internal flowbore, said apparatus comprising: a tubular exterior housing having an interior barrel extending between opposite distal ends of the barrel; first and second end plug means for environmentally sealing said interior barrel; an interior tube of less diameter than a diameter of said interior barrel having one end secured to said first end plug means and extending along an axis of said housing from said first end plug means; a selectively removed terminus secured to an opposite end of said interior tube; a selectively positioned partition secured to said interior tube between said terminus and said first end plug; a first bi-directional booster secured within said interior tube first end; a second bi-directional booster secured within said interior tube proximate of said opposite end; a third-bidirectional booster secured within said partition; and a first detonation cord between said first and second boosters being of substantially the same length as a second detonation cord between said first and third boosters.

2. An apparatus as described by claim 1 wherein first and second detonation cords are substantially simultaneously ignited by said first booster.

3. An apparatus as described by claim 1 having a first aperture in a wall of said interior tube adjacent said second booster.

4. An apparatus as described by claim 1 wherein said second detonation cord is helically wound about a timing spool between said first booster and said third booster.

5. An apparatus as described by claim 1 having a plurality of explosive material pellets serially aligned along said interior tube between said partition and said terminus.

6. An apparatus as described by claim 5 wherein said terminus is detachable from said interior tube for positioning said pellets along said tube.

7. An apparatus as described by claim 5 having resilient cushioning means between said terminus and said explosive pellets.

8. An apparatus as described by claim 1 wherein said exterior housing and said second end plug means are selectively detachable from remaining elements of said apparatus.

9. An apparatus as described by claim 1 having resilient cushioning means between said terminus and said second end plug means.

10. A method of severing a length of pipe having an internal flowbore, said method comprising the steps of providing a tubular housing for positioning within said flowbore at a desired point of pipe severance, said housing having an internal bore between opposite distal ends; providing a first end plug at a first distal end for environmentally sealing said internal bore; providing a second end plug at a second distal end for environmentally sealing said internal bore; providing a guide tube of less outside diameter than an inside diameter of said internal bore and less length than said internal bore between said end plugs; securing one end of said guide tube to said first end plug; providing a selectively positioned partition means along the length of said guide tube between said first end plug and an opposite end of said guide tube providing a first explosive booster in said guide tube at said one end; providing a second explosive booster in said guide tube at said opposite end; providing a third explosive booster in said partition means; providing a first detonation cord having a first length between said first booster and said second booster; providing a second detonation cord having said first length between said first booster and said third booster; securing a plurality of explosive pellets along said guide tube between said partition and said opposite end; positioning said explosive pellets within said housing at a desired point of pipe severance; and, detonating said first explosive booster.

11. A method as described by claim 10 wherein said first and second detonation cords are substantially simultaneously ignited by said first booster.

12. A method as described by claim 10 wherein said second detonation cord is helically wound about a timing spool secured to said guide tube between said first end plug and said partition.

13. A method as described by claim 10 wherein said explosive pellets are secured along said guide tube prior to sealing said internal bore by said first end plug.

* * * * *